United States Patent [19]

Körner et al.

[11] Patent Number: 4,458,120

[45] Date of Patent: Jul. 3, 1984

[54] HIGH-VOLTAGE CIRCUIT BREAKER

[75] Inventors: Gerhard Körner, Schriesheim; Horst Plettner, Hanau, both of Fed. Rep. of Germany

[73] Assignee: BBC Brown, Boveri & Company, Limited, Baden, Switzerland

[21] Appl. No.: 397,774

[22] Filed: Jul. 13, 1982

[30] Foreign Application Priority Data

Jul. 14, 1981 [DE] Fed. Rep. of Germany ..... 3127678

[51] Int. Cl.[3] ..... H01H 33/82

[52] U.S. Cl. ..... 200/148 A; 200/148 D; 200/148 F

[58] Field of Search ..... 200/148 A, 150 G, 148 D, 200/148 F, 148 R

[56] References Cited

U.S. PATENT DOCUMENTS

| | | | |
|---|---|---|---|
| 3,331,935 | 8/1967 | Milianowicz | 200/150 G X |
| 4,011,421 | 3/1977 | Thaler | 200/148 A |

FOREIGN PATENT DOCUMENTS

| | | |
|---|---|---|
| 1236631 | 3/1967 | Fed. Rep. of Germany . |
| 2015473 | 8/1970 | Fed. Rep. of Germany . |
| 1690503 | 3/1971 | Fed. Rep. of Germany . |
| 7100590 | 11/1972 | Fed. Rep. of Germany . |
| 2245423 | 3/1974 | Fed. Rep. of Germany . |
| 2611784 | 3/1976 | Fed. Rep. of Germany . |
| 1966973 | 4/1977 | Fed. Rep. of Germany . |
| 607292 | 7/1977 | Fed. Rep. of Germany . |
| 2108871 | 5/1980 | Fed. Rep. of Germany . |
| 2741357 | 5/1980 | Fed. Rep. of Germany . |

*Primary Examiner*—E. A. Goldberg
*Assistant Examiner*—Morris Ginsburg
*Attorney, Agent, or Firm*—Burns, Doane, Swecker & Mathis

[57] ABSTRACT

A high-voltage circuit breaker having a fixed contact and a movable contact also has a piston/cylinder system for generating a quenching gas flow to extinguish an arc during a switching action. The piston of the piston/cylinder system is connected to the movable contact. For the purpose of increasing the pressure in the quenching gas flow and for extending the blowing process, an auxiliary piston is provided on the opposite side of the fixed cylinder wall as the main piston. The auxiliary piston is driven in conjunction with the movable contact and the main piston of the piston/cylinder system in such a manner that it is moved in the first half of the circuit-breaking movement in opposition to the direction of movement of the main piston, and in the second half of the circuit-breaking movement in synchronism with the piston of the piston/cylinder system, into a circuit breaking position. In the first half of the movement the space between the auxiliary piston and the fixed cylinder wall is compressed so that the gas located therein is pushed into the space between the cylinder and the main piston of the piston/cylinder system.

7 Claims, 2 Drawing Figures

HIGH-VOLTAGE CIRCUIT BREAKER

Figure 1:
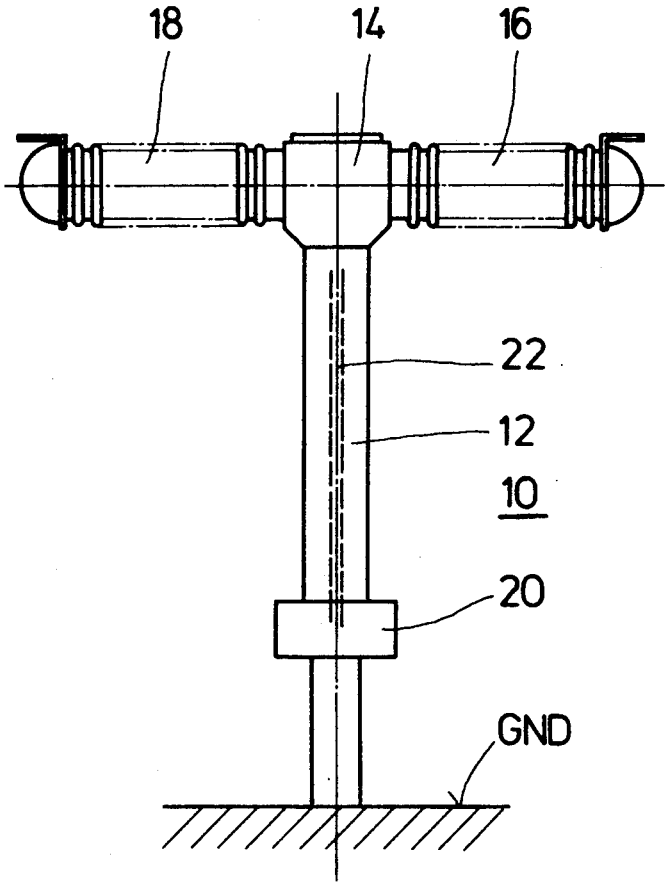

The invention relates to high-voltage circuit breaker of the type having a piston attached to a movable contact to compress quenching gas during a circuit breaking operation.

Such circuit breakers generate the quenching gas flow by a piston that is moved, in conjunction with the movable switching part, e.g. contact, relative to a cylinder or conversely a cylinder being moved relative to a fixed piston so that the space between the piston and the cylinder is compressed and the gas contained therein is thus compressed for the purpose of generating the arc-quenching gas flow.

In U.S. Pat. No. 3,331,935 an SF6 circuit breaker has been disclosed which has a cylinder which, together with the blowing nozzle, during a switching-off process is pulled over a piston in such a manner that the space below the blowing nozzle and above the piston is reduced so that the gas in this space is compressed and supplied to the arc for the purpose of quenching the arc. The piston is constructed as a movable piston which is loaded by the pressure of a spring for movement in opposition to the direction of switching off. In the switched-on condition, the piston is held in the switched-on position by means of a latch arrangement and is released at the beginning of a switching-off action so that the piston provides an additional contribution to the reduction of the space in which the quenching gas is located. The additional reduction in the quenching gas space results, if additional control valves are provided in the movable piston, in a distinct increase in pressure compared with the case where the piston is fixed. The piston is driven independently of the drive for the movable switching part. In this arrangement, a special latch arrangement and an accurate adjustment of the compression spring is necessary for the piston to shift with a sufficiently synchronous movement together with the movable switching part and the cylinder. Such an arrangement is complicated and installation takes a relatively long time because of the spring adjustment. In addition, the problem of sealing is relatively great due to the fact that the piston itself is movable.

It is the object of the invention to simplify the circuit breaker of the type generally referred to above, with control of the gas pressure taking place in exact synchronism with the course of movement of the movable or mobile switching parts.

According to the invention, this object is achieved by the fact that at the side, of the fixed piston, opposite to the contact point an additional auxiliary piston is disposed which, together with the movable switching part and the cylinder of the piston/cylinder system, is driven in such a manner that it is moved in the first half of the switching-off movement in opposition to the direction of movement of the cylinder and thus compresses the space between itself and the fixed piston so that the gas contained therein pushes into the space between the cylinder and the piston of the piston/cylinder system and that the auxiliary piston is moved in the second half of the switching-off movement in synchronism with the cylinder of the piston/cylinder system into the switching-off position.

The advantage achieved with this arrangement is particularly found in the fact that an accurate and exact control of the movement of the auxiliary piston is obtained without springs which can age in the course of time. The common movement of the auxiliary piston and the correct reversal of direction of the auxiliary piston will prevent with certainty changes in the compressed gas flow in the course of time. In addition, installation has also been simplified and the risk that the auxiliary piston fails because of the latching device becoming jammed, as in U.S. Pat. No. 3,331,935, can be avoided.

Figure 2:
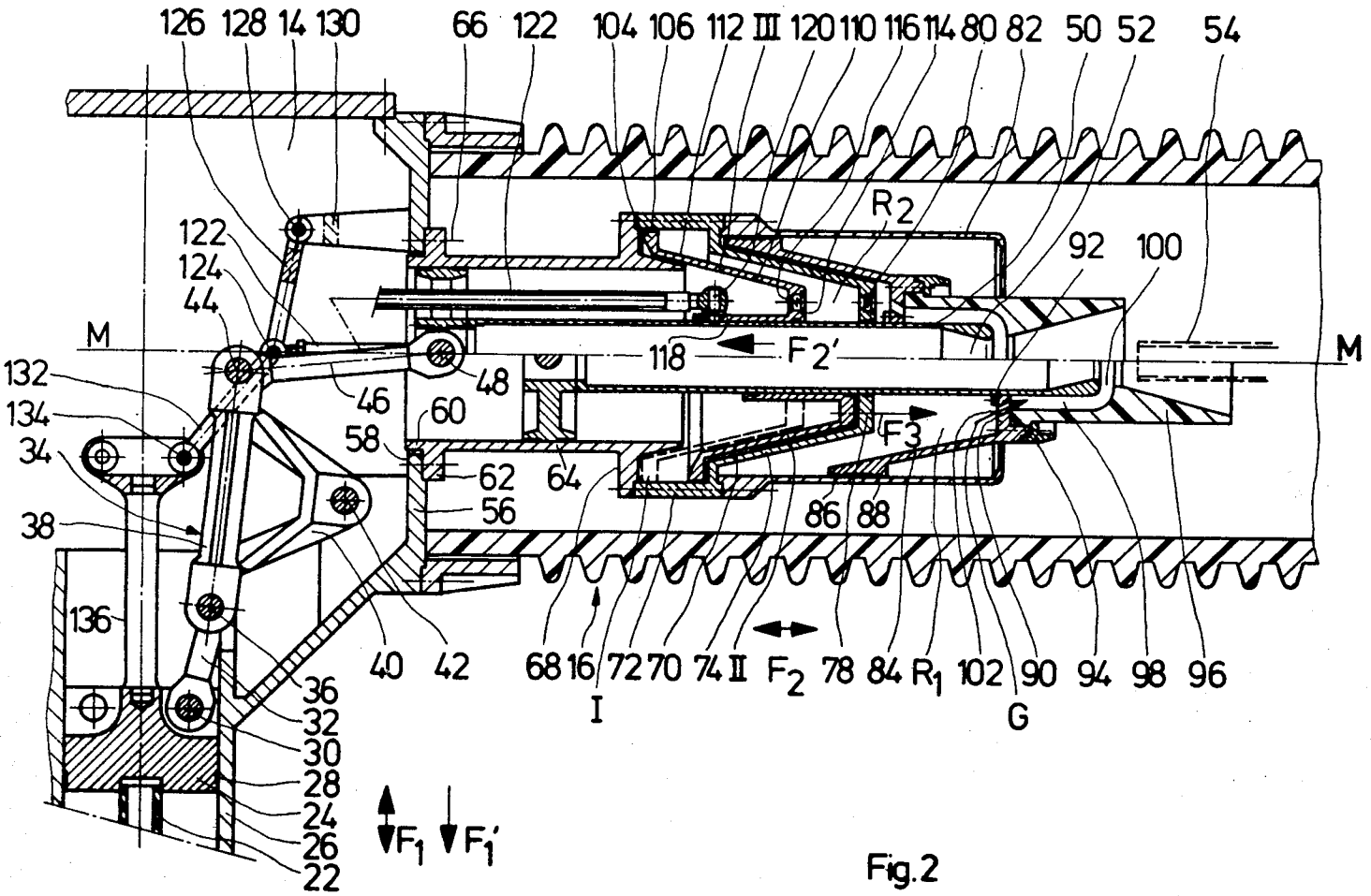

The invention and further advantageous developments and improvements of the invention will be explained and described in greater detail with the aid of the drawing, in which an illustrated embodiment of the invention is shown and in which:

FIG. 1 shows a side view of an outdoor-type high-voltage SF-gas insulated circuit breaker, and FIG. 2 shows a sectional view of the right-hand power switch contact in two positions, that is to say the switched-on position (below the center line) and the switched-off position (above the center line).

The outdoor-type high voltage power switch has in FIG. 1 the reference number 10. Diagrammatically seen, the circuit breaker has a contact column 12, at the upper end of which a reversal box 14 is mounted on both sides of which the circuit breaker chambers 16 and 18 are mounted. The circuit breaker chambers 16 and 18 are driven via an hydraulic or pneumatic drive system 20; the operation of this system does not need to be explained in greater detail in this disclosure since it is general state of the art. The drive power is transferred via an insulating rod 22 running in the interior of the contact column 12 and being connected to a guide piston 24 which runs in the interior of a guide tube 26 which is joined to the contact column 12. The guide piston 24 runs in the guide tube 26 via seals 28. At the top of the guide piston 24 a first lever 32 of a reversal linkage 34 is pivoted via an axle 30 and at the free end of this first lever an intermediate lever 38 is pivoted via another pivoting axle 36, the intermediate lever being attached to a V-shaped supporting double arm 40 and thereby joining the two arms with each other, and this supporting double arm being mounted at the intermediate housing 14 via an axle 42, which is supported in such a manner as it can be pivoted around this axle. The other end of the intermediate lever 38 is also provided with an axle 44, at which a transmission lever 46 is pivoted which is connected, via another pivoting axle 48, to the movable switching part 50 of the power circuit breaker chamber 16. The movable switching part 50 is constructed as a tubular switching part and has at the end opposite to the axle 48 a nozzle 52 which acts in conjunction with a fixed contact tube 54 in the switched-on condition (see drawing below the center line M—M).

The reversing gear or the reversing linkage 38 is used to reverse the movement of the drive, which occurs in the direction of the arrow F1, into the movement of the movable switching part 50 which takes place in the direction of the arrow F2.

The housing 14 is joined towards the circuit breaker chamber 16 by an end wall 56 which is provided with an opening 58 which is engaged by a projection 60 at a flange 62 of a supporting tube 64; the supporting tube 64 is firmly joined via a bolt-and-nut connection 66 to the end wall 56 of the reversing housing 14. The free end of the supporting tube 64 is provided with a collar-type flange 68 which is joined to the bottom 70 of a piston/-cylinder arrangement for generating the quenching gas flow in the power switch. The cylinder bottom itself has a tubular section 72 which is joined to a truncated-cone shaped section 74 which is closed off by a planar bottom 78. In the bottom 78 there are several non-return valves 80 (only one can be seen) arranged in such a way that they allow gas to flow only in the direction of the arrow F3. The cylindrical tube section outside the truncated-cone type region is joined to a cylindrical tube 82 which is open towards the right-hand side and in which a truncated-cone-type piston 84 is running via seals 86 and 88, this piston being provided with a flange-type ring at the side opposite to the seals 86 and 88, this ring being firmly joined to the movable switching part 50 via a bolt-and-nut connection 92. A nozzle 96 of insulating material is firmly joined via an additional clamping ring 94 to the piston 84. The nozzle 96 of insulating material is constructed in such a manner that, in conjunction with the movable contact part 50, it forms a duct 98 which, as will be explained further below, forms a radial circular access duct 100 in the direction of the actual contact point 50/54. The cylinder bottom 70, the cylindrical tube 82 and the piston 84 form the above-mentioned piston/cylinder arrangement.

In the case of a switching action between On and Off, the insulating rod is pulled in the direction of the arrow F1' and via the reversing gear 34 the movable switching part 50 is pulled in the direction of F2'. This causes the piston 84 to move over the annular web 90 in opposition to the cylinder bottom 70 so that the space R1 which is formed by the piston 84, the cylindrical tube 82, the cylinder bottom 70 and the bottom 78 is reduced, which causes the SF6 gas located in this space to flow through openings 102 in the ring 90 in the direction of arrow G into the duct 98 and to be supplied via the duct 100 to the arc in the case of a switching-off action. The switching-on position is drawn above the center line M—M and the switching-off position, in which the space R1 has the smallest dimensions, is drawn above the center line.

Below the cylinder bottom 70, that is to say at the side opposite to the space R1, an auxiliary piston 110 is mounted, which has a conically tapered area 112, 69 the large-diameter end of which a flange-type collar 104 is molded, which runs in the interior of the cylindrical tube or area 72 via seals 106 in a movable and sealed manner. The other end of the auxiliary piston 110, that is to say the smaller-diameter end, has a bottom 114 which is provided with a non-return valve 116 which admits a gas flow also only in the direction of the arrow F3. The bottom 114 is joined in the direction of expansion of the truncated-cone-type region 112 to a cylindrical tube type extension 118, at the outer surface of which a pivoting axle 120 is mounted, at which a drive rod 122 is pivoted. In FIG. 2 the axle 120 and the drive rod 122 has been drawn above the center line M—M rotated by 90 degrees and in the interior of the reversing housing 14 a part of the drive rod 122 can be seen in correct representation, the free end of the drive rod 122 being provided with a pivoting pin 124, at which a lever 126, which is supported to be stationary via an axle 128 at a support element 130, and another lever 132 are pivoted, the other end of this other lever being connected via another pivoting pin 134 to be hinged at another rod 136 which is attached to the guide piston 24, the axle of the drive or insulating rod 22 being aligned with the center axis of the rod 136.

As can be seen from FIG. 2, the auxiliary piston 110 has a total of three positions. The dashed position I shows the auxiliary piston in its switched-on position. As soon as the drive rod 22 is moved in the direction of arrow F1' and the movable contact part is moved in the direction of arrow F2', the auxiliary piston is shifted via the rods 126, 132 and 122 from position I to the solidly drawn position II in which the auxiliary piston is approximately in the position in which the movable contact part is half-way along during the switching-off operation. In order to switch off completely, the auxiliary piston 110 then moves into position III. The auxiliary piston 110 is adapted to the shape to the fixed cylinder bottom 70 and the cylindrical area 118 encircles the movable switching part in a slideway or sliding seal arrangement.

Below the center line M—M the circuit breaker is shown in the position in which it has moved half-way along to the switching-off position. In this case the auxiliary piston is practically completely resting against the fixed cylinder bottom. In the position above the line M—M, the circuit breaker is shown in its switched-off position and because the auxiliary piston is reversed in its movement the switched-on position into the central and then again into the switched-off position, the space R2 below the fixed cylinder bottom is reduced so that the gas located in this space R2 is compressed in the direction of the arrow F3 into the space R1 so that the pressure of the SF6 gas in the interior of the space R1 is increased, which makes it possible for a greater total power to be switched. Control of this movement takes place while the rods 122, 126 and 132, in which arrangement the rod 126 can only rotate in a circle around the stationary axle 128. The desired reversal of motion of the auxiliary piston 110 is effected on the basis of the spatial allocation of the individual rods to the support 130 and the axle 128, respectively.

We claim:

1. A high-voltage circuit breaker, comprising:

a fixed contact;

a movable contact including a drive system for moving it relative to said fixed contact;

a piston/cylinder system for compressing a quenching gas during movement of said movable contact, said system including a cylinder with a stationary wall towards which a main piston moves to compress the quenching gas;

an auxiliary piston disposed on the side of said stationary wall that is opposite the side facing said main piston;

means responsive to actuation of said drive system for moving said auxiliary piston towards said stationary wall in opposition to the direction of movement of said main piston during the first half of a circuit breaking operation by the circuit breaker, and for moving said auxiliary piston in the same direction as said main piston during the second half of the circuit breaking operation; and means for admitting gas compressed in the space between said auxiliary piston and said stationary wall during said first-half movement into the space between said main piston and said stationary wall.

2. The circuit breaker of claim 1 wherein said admitting means comprises a one-way valve disposed in said stationary wall.

3. The circuit breaker of claim 2 further including a one-way valve disposed in the auxiliary piston so as to admit gas flow only into the space between the auxiliary piston and the stationary wall.

4. The circuit breaker of claim 1, wherein the auxiliary piston has a shape complementary to the shape of the stationary cylinder wall and a collar-type flange which slides in a sealed manner in a cylindrical extension of the stationary cylinder wall.

5. The circuit breaker of claim 4 wherein the stationary cylinder wall has the shape of a truncated cone and the auxiliary piston also has the shape of a truncated cone, said collar-type flange being disposed at the larger-diameter end of the auxiliary piston, and further including a one-way valve mounted in a radial face disposed at the smaller-diameter end of the auxiliary piston.

6. The circuit breaker of claim 5, further including a cylindrical extension attached to said radial face which encircles said movable contact with a sliding seal and which can slide relative to it, and wherein said moving means includes a drive rod pivoted to said extension for the purpose of actuating the auxiliary piston.

7. The circuit breaker of claim 6, wherein the free end of the drive rod for the auxiliary piston is connected to a main drive rod by means of a reversing mechanism, said main drive rod being part of said drive system for the circuit breaker.

* * * * *